US011516589B2

(12) United States Patent
Song et al.

(10) Patent No.: US 11,516,589 B2
(45) Date of Patent: Nov. 29, 2022

(54) SOUNDING DEVICE

(71) Applicant: AAC Microtech (Changzhou) Co., Ltd., Changzhou (CN)

(72) Inventors: Wei Song, Shenzhen (CN); Zhiwei Zhong, Shenzhen (CN); Xin Jin, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/531,815

(22) Filed: Nov. 22, 2021

(65) Prior Publication Data

US 2022/0174410 A1 Jun. 2, 2022

(30) Foreign Application Priority Data

Nov. 30, 2020 (CN) ..... 202022844966.7

(51) Int. Cl.

| | |
|---|---|
| ***H04R 9/06*** | (2006.01) |
| ***H04R 9/02*** | (2006.01) |
| ***H04R 7/18*** | (2006.01) |
| ***H04R 9/04*** | (2006.01) |
| ***H04R 1/02*** | (2006.01) |

(52) U.S. Cl.

CPC ..... *H04R 9/025* (2013.01); *H04R 1/021* (2013.01); *H04R 7/18* (2013.01); *H04R 9/043* (2013.01); *H04R 9/06* (2013.01); *H04R 2209/027* (2013.01); *H04R 2400/11* (2013.01); *H04R 2499/11* (2013.01)

(58) Field of Classification Search

CPC ..... H04R 1/1021; H04R 7/18; H04R 9/025; H04R 9/043; H04R 9/06; H04R 2209/027; H04R 2400/11; H04R 2499/11

See application file for complete search history.

(56) References Cited

U.S. PATENT DOCUMENTS

| | | | | |
|---|---|---|---|---|
| 2020/0045426 | A1* | 2/2020 | Song | H04R 1/06 |
| 2022/0174381 | A1* | 6/2022 | Jin | H04R 1/021 |
| 2022/0174421 | A1* | 6/2022 | Song | H04R 9/025 |

* cited by examiner

*Primary Examiner* — Huyen D Le

(74) *Attorney, Agent, or Firm* — W&G Law Group

(57) ABSTRACT

A sounding device includes a positioning bracket, a vibration system including diaphragm and voice coil, and a magnetic circuit system including yoke fixed to the positioning bracket and magnet. The yoke includes yoke body fixed to the magnet, yoke sidewall bending and extending from periphery of the yoke body to the diaphragm, and yoke extension portion bending and extending from the yoke sidewall to the positioning bracket. The positioning bracket includes positioning bracket body and positioning slot formed by depression from one side of the positioning bracket body close to the yoke to the diaphragm. One side of the yoke extension portion close to the diaphragm abuts against a bottom surface of the positioning slot. One end of the yoke extension portion away from the yoke sidewall is fixed to the positioning bracket. The sounding device has a simple structure, high strength, easy assembly and positioning, and high reliability.

10 Claims, 7 Drawing Sheets

B-B

SOUNDING DEVICE

TECHNICAL FIELD

The disclosure relates to the field of electroacoustic conversion, and in particular, to a sounding device applied to electronic speaker products.

BACKGROUND

With the advent of the mobile interne era, the number of smart mobile devices continues to rise. Among many mobile devices, mobile phones are undoubtedly the most common and portable mobile terminal devices. The mobile phones have extremely diverse functions, one of which is the high-quality music function. Therefore, sounding devices configured to play sound are widely used in today's smart mobile devices.

In the related art, the sounding device includes a positioning bracket, a vibration system fixed to the positioning bracket, and a magnetic circuit system configured to drive the vibration system to vibrate to produce sound. The magnetic circuit system includes a yoke fixed to the positioning bracket and a magnet received in the yoke. The yoke is fixed to the positioning bracket by gluing.

However, the positioning bracket of the sounding device in the related art is generally made of plastic, and the plastic has low strength, which is easy to cause deformation of the sounding device. Since the yoke is fixed to the positioning bracket by gluing, the yoke and the positioning bracket are prone to move relative to each other during the fixation by gluing, which makes positioning of the magnetic circuit system more difficult, resulting in low reliability of the sounding device.

Therefore, there is a need to provide a sounding device to solve the above technical problems.

SUMMARY

An objective of the disclosure is to provide a sounding device which has a simple structure, high strength, easy assembly and positioning, and high reliability.

In order to achieve the above objective, the disclosure provides a sounding device. The sounding device includes a positioning bracket, a vibration system fixed to the positioning bracket, and a magnetic circuit system configured to drive the vibration system to vibrate to produce sound. The vibration system includes a diaphragm fixed to the positioning bracket and a voice coil configured to drive the diaphragm to vibrate. The magnetic circuit system includes a yoke fixed to the positioning bracket and a magnet received in the yoke. The yoke includes a yoke body and a yoke sidewall bending and extending from a periphery of the yoke body towards the diaphragm, the magnet is fixed to the yoke body and spaced apart from the yoke sidewall to form a magnetic gap, and the voice coil is inserted in the magnetic gap. The positioning bracket includes a positioning bracket body and at least one positioning slot, and one side of the positioning bracket body close to the yoke is recessed towards the diaphragm to form the at least one positioning slot. The yoke further includes at least one yoke extension portion bending and extending from the yoke sidewall towards the positioning bracket and received in one of the at least one positioning slot. One side of one of the at least one yoke extension portion close to the diaphragm abuts against a bottom surface of one of the at least one positioning slot, and one end of one of the at least one yoke extension portion away from the yoke sidewall is fixed to the positioning bracket.

As an improvement, the positioning bracket is made of a metal material, and one side of one of the at least one yoke extension portion away from the yoke sidewall has a part in contact with the positioning bracket, wherein the part is welded to the positioning bracket by laser.

As an improvement, the vibration system further includes a framework fixed to one side of the diaphragm close to the magnetic circuit system and an elastic support component elastically supporting the framework. The elastic support component has one end fixed to the positioning bracket body and another end fixed to the framework, and the voice coil is connected to the diaphragm through the framework.

As an improvement, the framework includes a framework body in a ring shape and fixed to the diaphragm, a first framework fixing portion extending from an outer periphery of the framework body towards the magnetic gap, and at least one second framework fixing portion extending from an inner periphery of the framework body towards the voice coil. The elastic support component is connected to one end of the first framework fixing portion away from the framework body, and the voice coil is connected to the at least one second framework fixing portion.

As an improvement, the at least one second framework fixing portion includes a plurality of second framework fixing portions that is spaced apart from each another.

As an improvement, the positioning bracket further includes two first bracket fixing portions each bending and extending from one side of the positioning bracket body away from the diaphragm towards the yoke, the two first bracket fixing portions each are spaced apart from the yoke, and one end of the elastic support component is fixed to the positioning bracket body and the two first bracket fixing portions.

As an improvement, the positioning bracket further includes two second bracket fixing portions each bending and extending from one side of the positioning bracket body away from the diaphragm towards the yoke, the two second bracket fixing portions are respectively located at two opposite sides of a major axis of the positioning bracket and are spaced apart from the yoke, and one end of one of the at least one yoke extension portion away from the yoke sidewall is fixed to the positioning bracket body and one of the two second bracket fixing portions.

As an improvement, the at least one positioning slot includes two positioning slots respectively located at two opposite sides of a major axis of the positioning bracket, the yoke is of a rectangular structure, the at least one yoke extension portion includes two yoke extension portions respectively located at two opposite sides of a major axis of the yoke, and the two yoke extension portions are in one-to-one correspondence to the two positioning slots.

As an improvement, the diaphragm includes a vibration portion, a suspension portion bending and extending from an outer periphery of the vibration portion, and a connection portion bending and extending from the suspension portion towards the positioning bracket. The voice coil is fixed to the vibration portion, the connection portion is fixed to the positioning bracket body, the suspension portion is recessed towards the yoke to form an arc-shaped structure directly opposite to one of the at least one positioning slot, and a distance between the suspension portion and the positioning slot is greater than a maximum vibration amplitude of the suspension portion.

As an improvement, the diaphragm further includes a reinforcement portion bending and extending from an outer periphery of the connection portion along an extension direction of the positioning bracket body. The reinforcement portion has a ring shape and is fixed to the positioning bracket body.

Compared with the related art, in the sounding device according to the disclosure, one side of the positioning bracket body of the positioning bracket close to the yoke is recessed towards the diaphragm to form the positioning slot, a bending and extending yoke extension portion is arranged on the yoke sidewall of the yoke, the yoke extension portion is received in the positioning slot, and one side of the yoke extension portion close to the diaphragm abuts against a bottom surface of the positioning slot. The structure uses a position of the yoke extension portion as a height positioning surface of the yoke, which enables the magnetic circuit system and the positioning bracket to be assembled and positioned accurately and reserves a sufficient vibration space for the vibration system. In the structure, one end of the yoke extension portion away from the yoke sidewall is fixed to the positioning bracket, so that the structure is simple, the positioning bracket is fixed to increase hardness of the structure, and the positioning bracket and the yoke are not prone to move relative to each other, which effectively ensures stability of fixation of the positioning bracket to the yoke, thereby improving reliability of the sounding device.

BRIEF DESCRIPTION OF DRAWINGS

In order to more clearly illustrate the technical solutions in embodiments of the disclosure, the accompanying drawings used in the description of the embodiments will be briefly introduced below. It is apparent that, the accompanying drawings in the following description are only some embodiments of the disclosure, and other drawings can be obtained by those of ordinary skill in the art from the provided drawings without creative efforts. In the drawings.

DESCRIPTION OF EMBODIMENTS

The technical solutions in the embodiments of the disclosure will be described clearly and completely below with reference to the accompanying drawings in the embodiments of the disclosure. The described embodiments are merely some of rather than all of the embodiments of the disclosure. All other embodiments acquired by those skilled in the art based on the embodiments of the disclosure shall fall within the protection scope of the disclosure.

Figure 1:
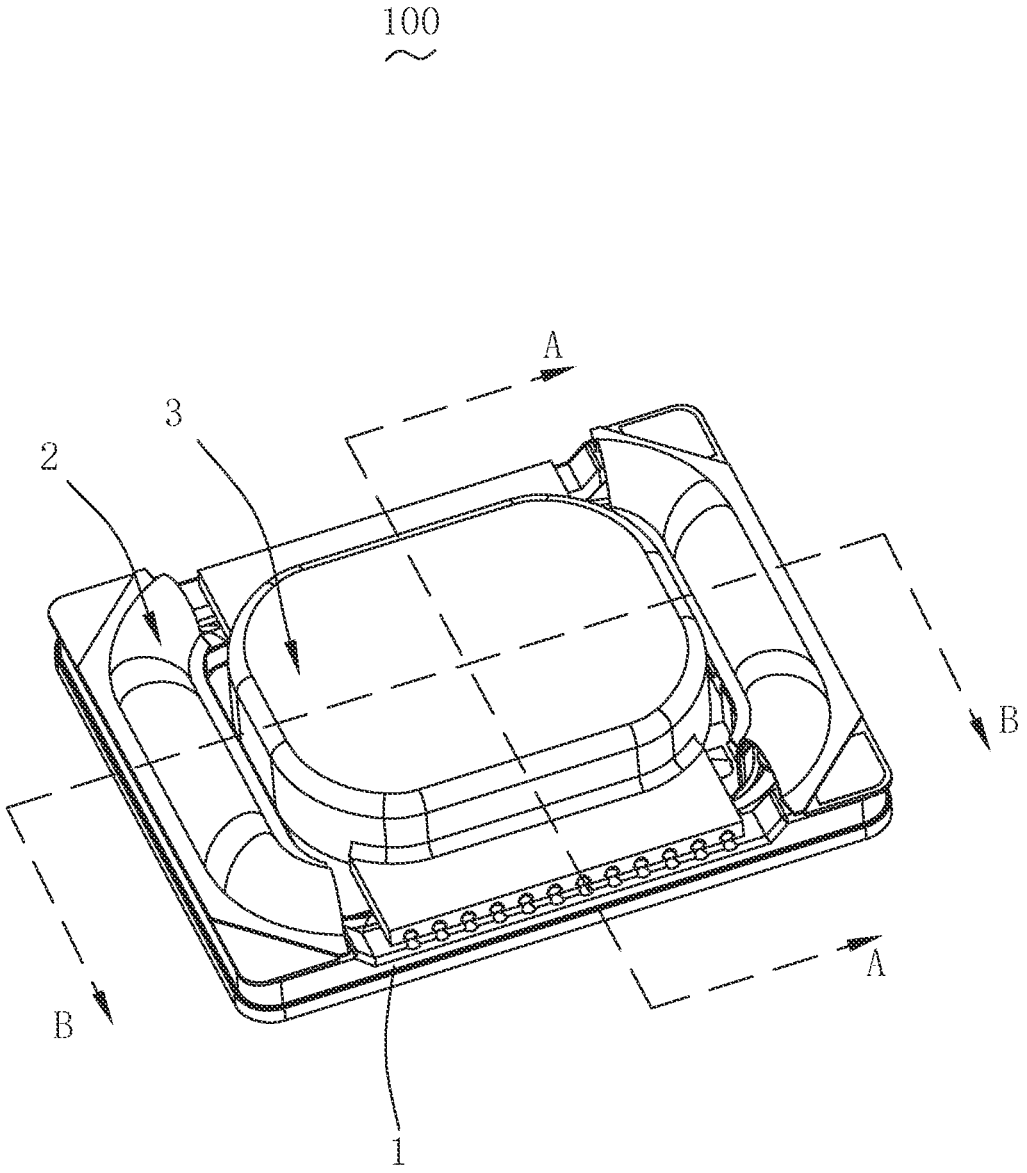
FIG. 1 is a schematic diagram of a three-dimensional structure of a sounding device according to the disclosure.
Figure 2:
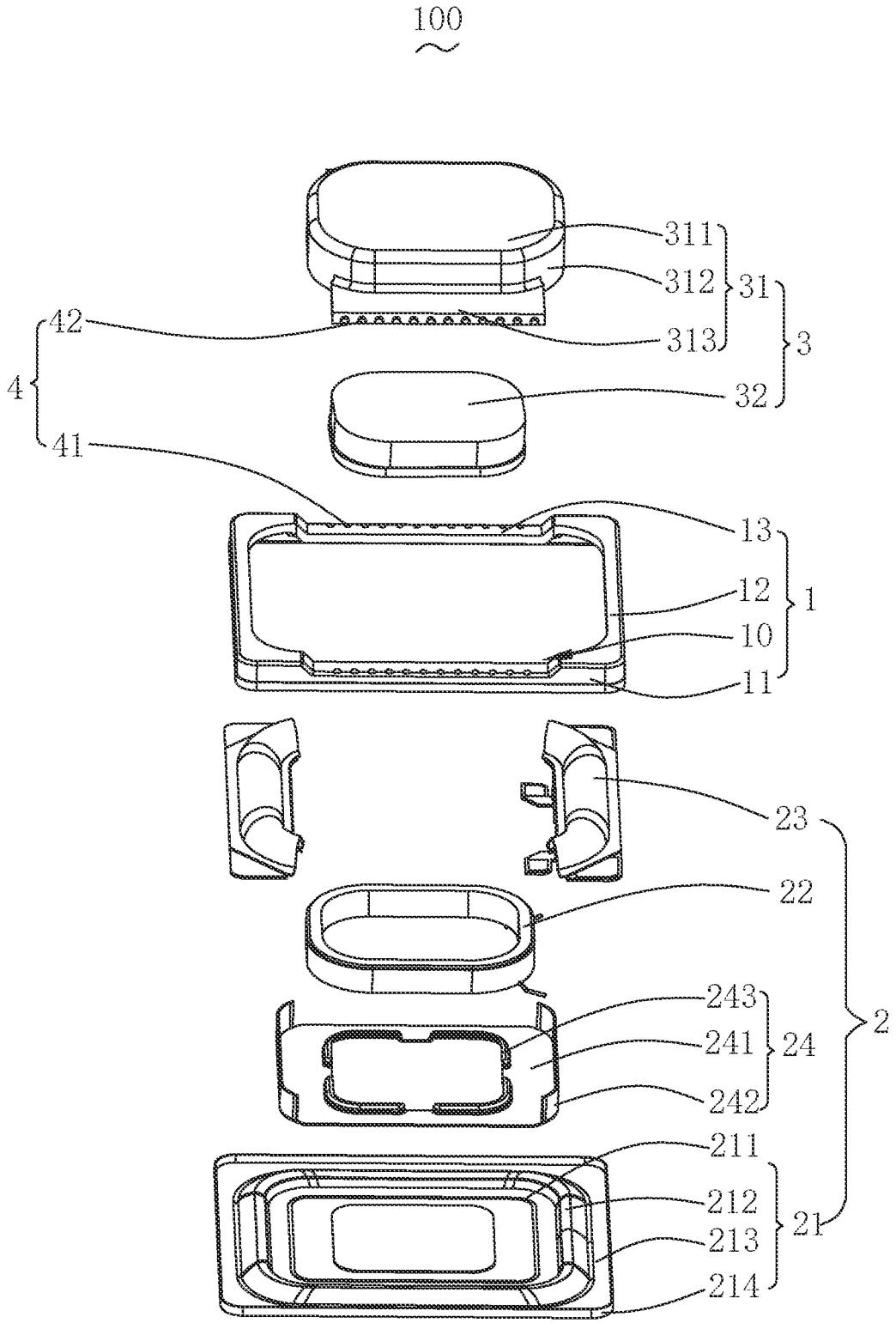
FIG. 2 is an exploded view of a partial three-dimensional structure of the sounding device according to the disclosure.
Figure 3:
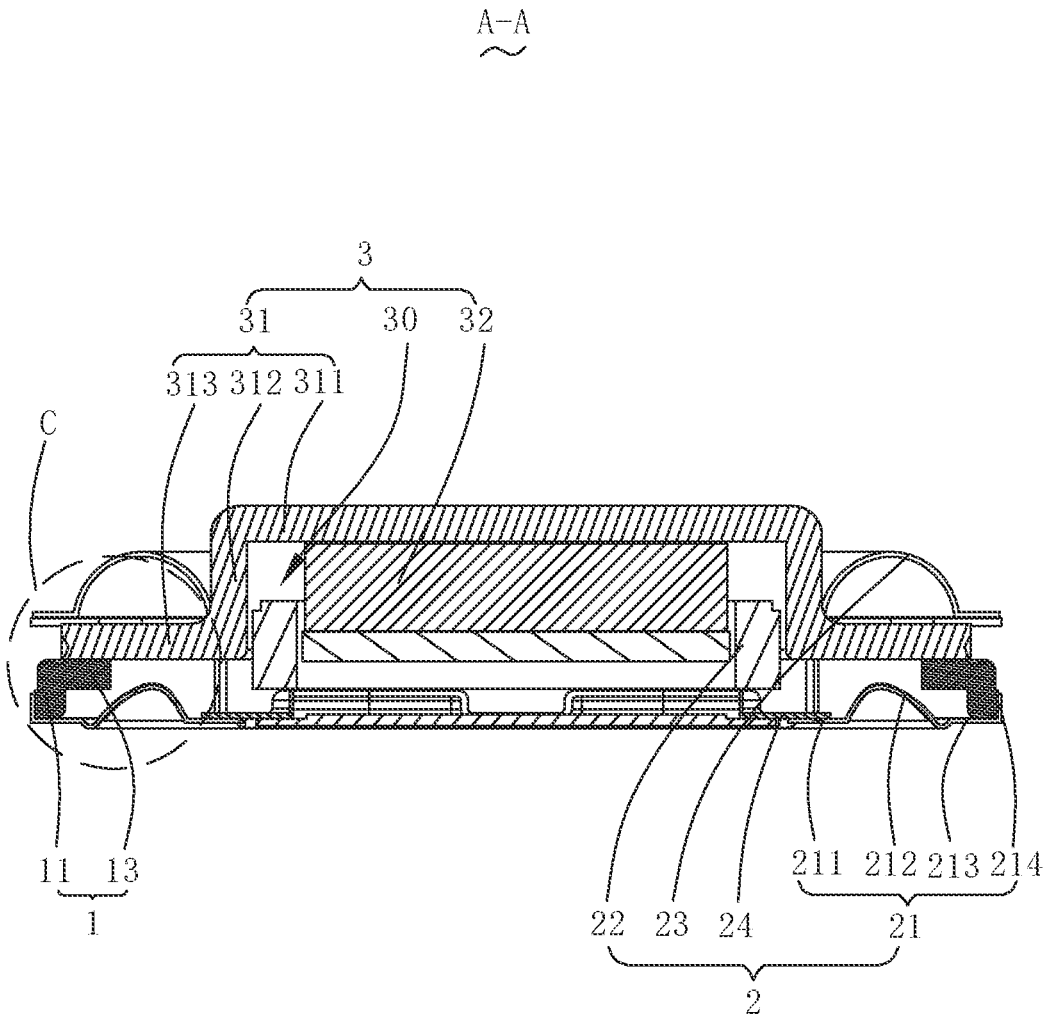
FIG. 3 is a sectional view taken along line A-A shown in FIG. 1.
Figure 4:
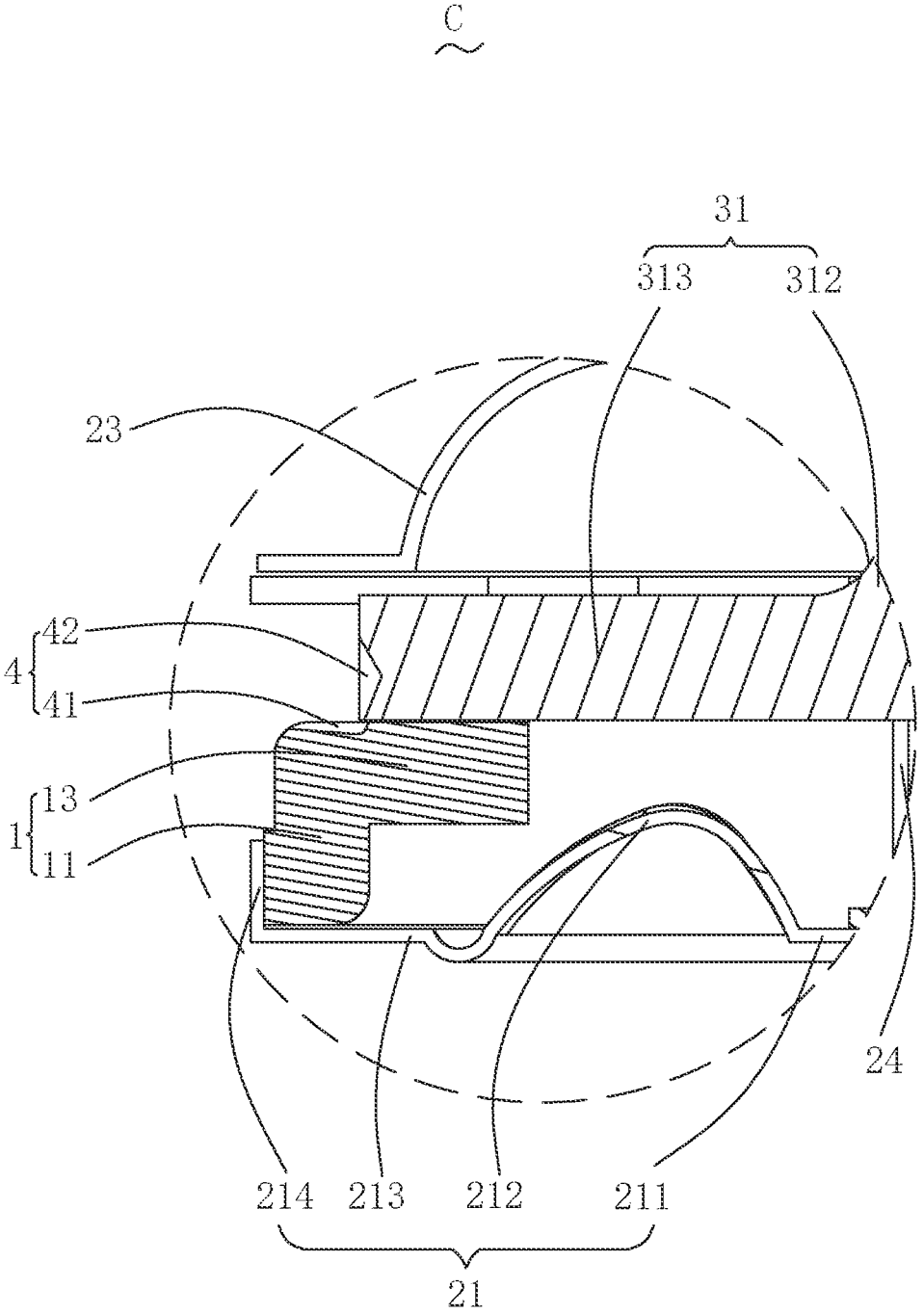
FIG. 4 is an enlarged view of a part C shown in FIG. 3.
Figure 5:
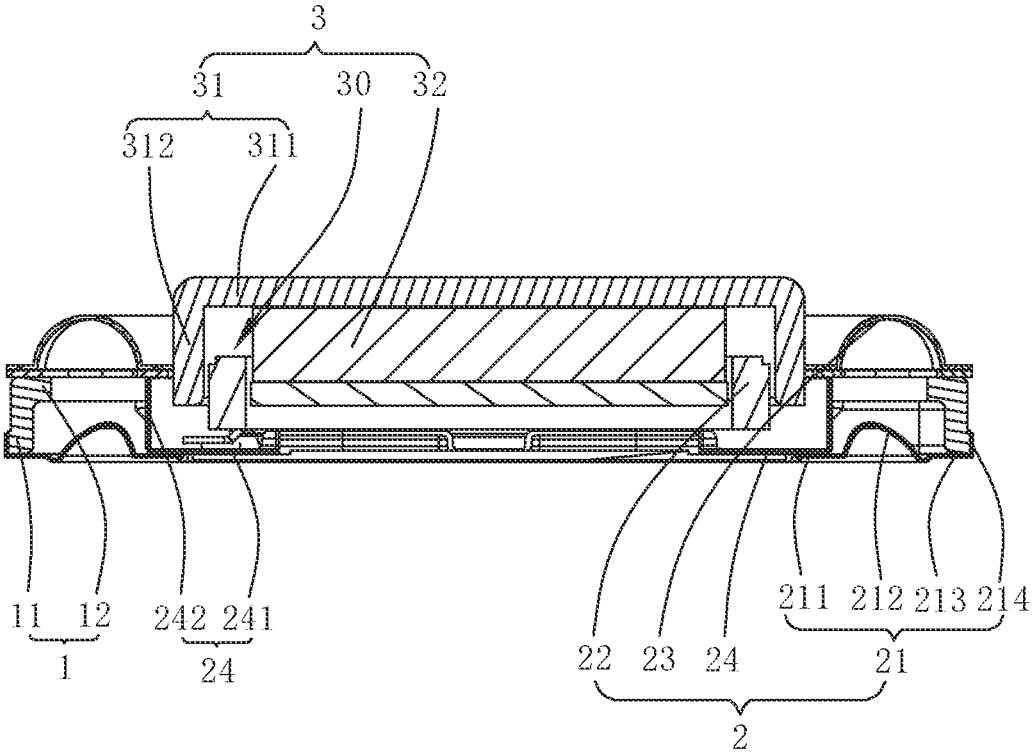
FIG. 5 is a sectional view taken along line B-B shown in FIG. 1.
Figure 6:
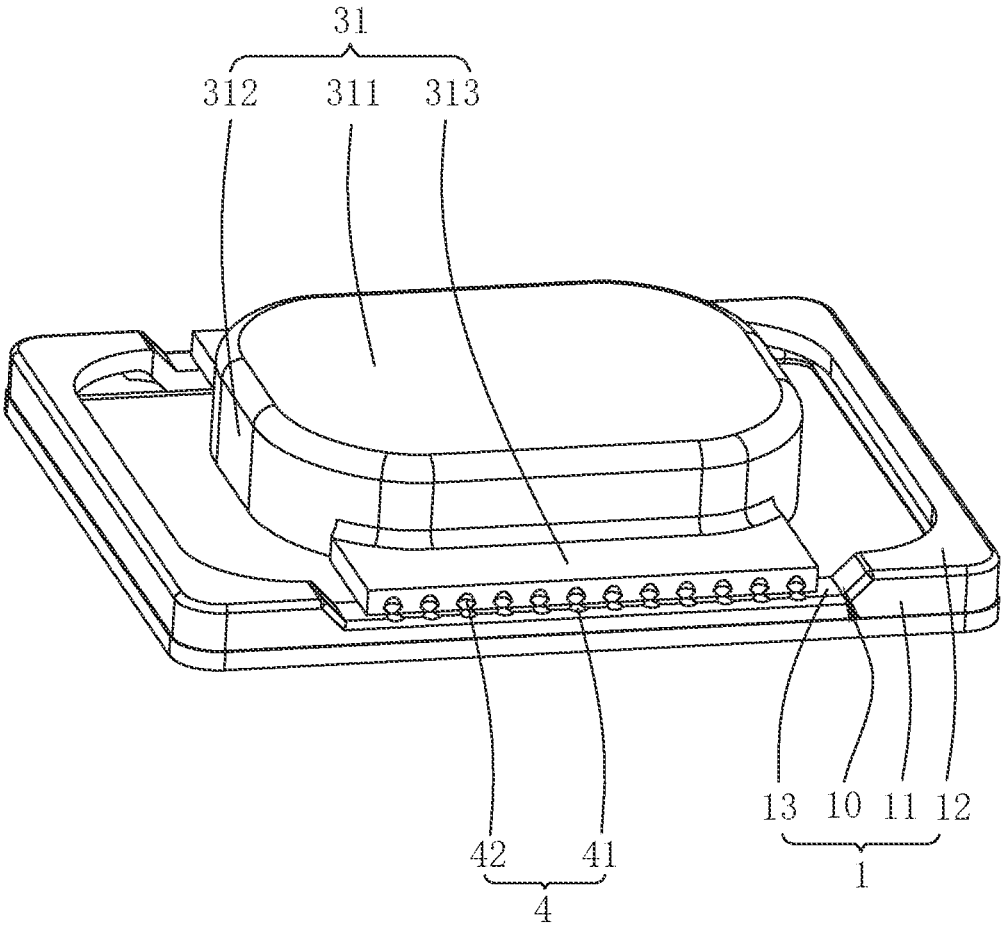
FIG. 6 is a schematic assembled view of a three-dimensional structure of a yoke and a positioning bracket of the sounding device according to the disclosure.
Figure 7:
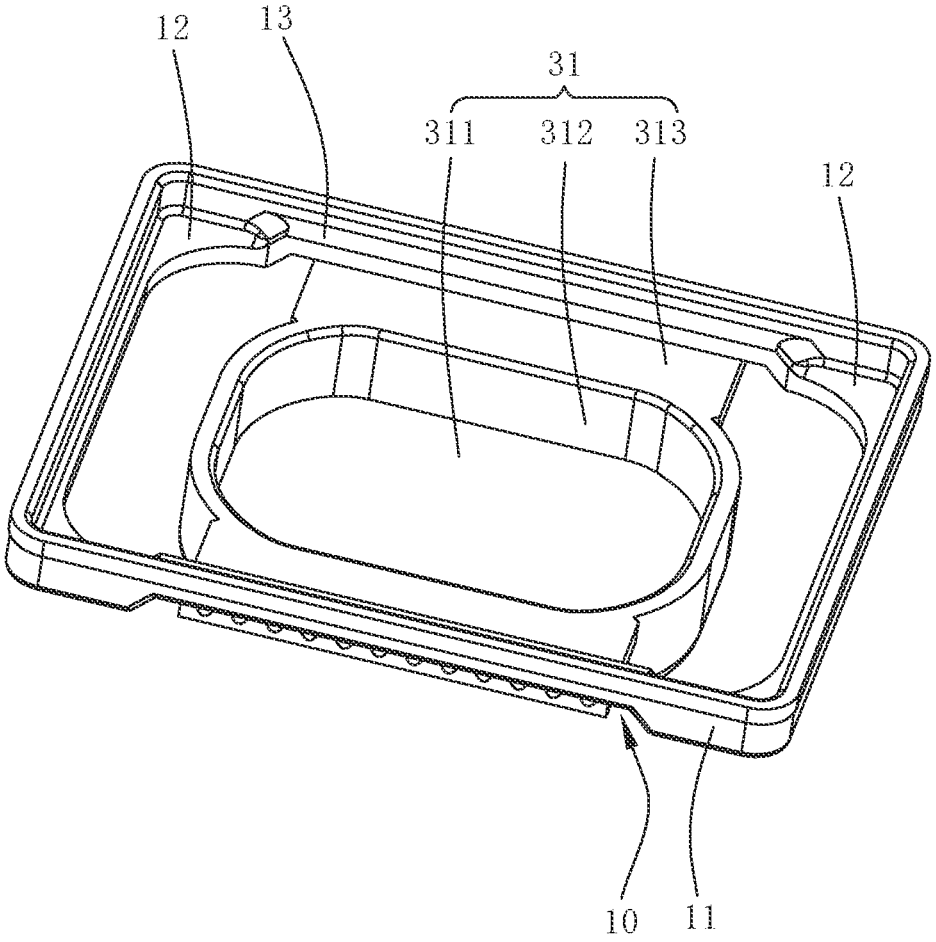
FIG. 7 is a schematic assembled view of a three-dimensional structure of the yoke and the positioning bracket of the sounding device according to the disclosure from another perspective.

Referring to FIG. 1 to FIG. 7, the disclosure provides a sounding device 100. The sounding device 100 includes a positioning bracket 1, a vibration system 2 fixed to the positioning bracket 1, and a magnetic circuit system 3 configured to drive the vibration system 2 to vibrate to generate sound.

In an embodiment, the positioning bracket 1 is made of metal. The positioning bracket 1 made of metal has higher hardness and is not prone to deform during use and assembly, thereby improving reliability of the sounding device 100.

The positioning bracket 1 is of a rectangular structure. In an embodiment, the positioning bracket 1 includes a positioning bracket body 11 and a positioning slot 10.

The positioning bracket body 11 is of a rectangular structure. The positioning bracket body 11 is configured to fix the vibration system 2.

One side of the positioning bracket body 11 close to the magnetic circuit system 3 is recessed towards the vibration system 2 to form the positioning slot 10. The positioning slot 10 is configured to be fixed to the magnetic circuit system 3 by laser welding.

In an embodiment, two positioning slots 10 are provided and are respectively located at two opposite sides of a major axis of the positioning bracket 1.

The vibration system 2 includes a diaphragm 21, a voice coil 22, an elastic support component 23, and a framework 24.

The diaphragm 21 is fixed to one side of the positioning bracket body 11 away from the yoke 31.

The diaphragm 21 includes a vibration portion 211, a suspension portion 212 bending and extending from an outer periphery of the vibration portion 211, and a connection portion 213. The suspension portion 212 is bent and extends towards the positioning bracket 1 to form the connection portion 213.

The connection portion 213 is fixed to the positioning bracket body 11.

The suspension portion 212 is recessed towards the yoke 31 to form an arc-shaped structure directly opposite the positioning slot 10. A distance between the suspension portion 212 and the positioning slot 10 is greater than a maximum vibration amplitude of the suspension portion 212.

In this embodiment, in order to fixation strength of the diaphragm 21 to the positioning bracket body 11, the diaphragm 21 can further include a ring-shaped reinforcement portion 214 bending and extending from an outer periphery of the connection portion 213 along an extension direction of the positioning bracket body 11. The reinforcement portion 214 is fixed to the positioning bracket body 11. When the diaphragm 21 vibrates to generate sound, the structure prevents a poor acoustic effect of the sounding device 100 caused by fall-off of the diaphragm 21 from the positioning bracket body 11, so that the sounding device 100 has high reliability.

The voice coil 22 is configured to drive the diaphragm 21 to vibrate to generate sound. The voice coil 22 is fixed to the vibration portion 211. In an embodiment, the voice coil 22 is connected to the diaphragm 21 through the framework 24.

The elastic support component 23 elastically supports the framework 24. The elastic support component 23 is fixed to the positioning bracket 1. For example, the elastic support component 23 has one end fixed to the positioning bracket body 11 and another end fixed to the framework 24. The elastic support component 23 is configured to balance the vibration of the voice coil 22. The elastic support component 23 provides a more stable support for the voice coil 22 and has better vibration reliability.

In an embodiment, two elastic support components 23 are provided and are respectively located at two opposite sides of a minor axis of the positioning bracket 1. The two elastic support components 23 symmetrically distributed provide a more stable support for the voice coil 22 and have better vibration reliability.

The framework 24 is fixed to one side of the diaphragm 21 close to the magnetic circuit system 3. For example, the framework 24 is fixed to one side of the vibration portion 211 close to the magnetic circuit system 3. The framework 24 includes a ring-shaped framework body 241 fixed to the diaphragm 21, a first framework fixing portion 242, and a second framework fixing portion 243. An outer periphery of the framework body 241 extends towards the voice coil 22 to form the first framework fixing portion 242. An inner periphery of the framework body 241 extends towards the voice coil 22 to form the second framework fixing portion 243. The elastic support component 23 is connected to one end of the first framework fixing portion 242 away from the framework body 241, and the voice coil 22 is connected to the second framework fixing portion 243. The structure enables the voice coil 22 to drive the diaphragm 21 to vibrate to produce sound through the framework 24, and to be connected to the elastic support component 23, so that the vibration has good balance and high feasibility.

In an embodiment, multiple second framework fixing portions 243 are provided and spaced apart from each another. The structure facilitates air circulation inside and outside the framework 24, so that the sounding device 100 has good acoustic performance.

The magnetic circuit system 3 includes a yoke 31 fixed to the positioning bracket 1 and a magnet 32 received in the yoke 31.

The yoke 31 includes a yoke body 311, a yoke sidewall 312, and a yoke extension portion 313 received in the positioning slot 10. A periphery of the yoke body 311 is bent and extends towards the diaphragm 21 to form the yoke sidewall 312. The yoke sidewall 312 is bent and extends towards the positioning bracket 1 to form the yoke extension portion 313. One side of the positioning bracket body 11 close to the yoke 31 is recessed towards the diaphragm 21 to form the positioning slot 10. The elastic support component 23 is spaced apart from the yoke 31.

The yoke body 311 is configured to fix the magnet 32. The yoke body 311 and the diaphragm 21 are respectively located on two opposite sides of the sounding device 100.

The yoke sidewall 312 is fixed to the positioning bracket 1.

The yoke extension portion 313 is configured to assemble and position of the magnetic circuit system 3, which reserves a sufficient vibration space for the vibration system 2.

One side of the yoke extension portion 313 close to the diaphragm 21 abuts against a bottom surface of the positioning slot 10. One end of the yoke extension portion 313 away from the yoke sidewall 312 is fixed to the positioning bracket 1. The structure is configured to assemble and position the magnetic circuit system 3 and the positioning bracket 1. The structure uses a position of the yoke extension portion 313 as a height positioning surface of the yoke 31, which enables the magnetic circuit system 3 and the positioning bracket 1 to be assembled and positioned accurately and reserves a sufficient vibration space for the vibration system 2. That is, the structure ensures the distance between the suspension portion 212 and the positioning slot 10 to be greater than the maximum vibration amplitude of the suspension portion 212.

In an embodiment, a part of one side of the yoke extension portion 313 away from the yoke sidewall 312 is in contact with the positioning bracket 1 and welded by laser. Through the fixation by laser welding, on the one hand, the positioning bracket 1 and the yoke extension portion 313 can be welded more firmly, thereby improving the reliability. On the other hand, laser welding can be operated on an outer side of the positioning bracket 1 and an outer side of the yoke 31. Laser oblique welding is easy to operate, which is conducive to manufacturing and assembly of the sounding device 100 and is conducive to mass production.

One side of the yoke extension portion 313 away from the yoke sidewall 312 and one side of the positioning slot 10 close to the yoke extension portion 313 are each provided with a fusion bulge 4. A metal material of the positioning bracket 1 is fused with a material of the yoke extension portion 313 to form the fusion bulge 4 by laser welding. The yoke extension portion 313 and the positioning slot 10 form welding fixation through the fusion bulge 4. The fusion bulge 4 is located at a junction between the yoke extension portion 313 and the positioning bracket 1.

In an embodiment, multiple fusion bulges 4 are provided and are spaced apart from each other and symmetrically distributed on the yoke extension portion 313 and the positioning bracket 1. The multiple fusion bumps 4 are formed by symmetrically distributed spot welding. The structure makes an assembly process simple and enables the positioning bracket 1 and the yoke extension portion 313 to be welded more firmly, thereby improving the reliability of the sounding device 100.

In an embodiment, the fusion bulge 4 includes a first fusion bulge 41 located at the positioning bracket 1 and a second fusion bulge 42 located at the yoke extension portion 313. The first fusion bulge 41 and the second fusion bulge 42 are connected to each other form one piece. The structure, on the one hand, makes full use of the simple operation of the laser oblique welding, which is conducive to manufacturing and assembly of the sound device 100 and is conducive to mass production, and on the other hand, enables the positioning bracket 1 and the yoke extension portion 313 to be welded more firmly, thereby improving the reliability.

The magnet 32 is fixed to the yoke body 311 and is spaced from the yoke sidewall 312 to form a magnetic gap 30. The voice coil 22 is inserted in the magnetic gap 30. The first framework fixing portion 242 extends from an outer periphery of the framework body 241 towards the magnetic gap 30.

In an embodiment, the yoke 31 is of a rectangular structure. Two yoke extension portions 313 are and respectively located at two opposite sides of a major axis of the yoke 31. Symmetric arrangement of the yoke extension portions 313 enables the positioning bracket 1 and the yoke 31 to be bonded more firmly, thereby improving the reliability of the sounding device 100, and enables the assembly and positioning of the magnetic circuit system 3 and the positioning bracket 1 to be more accurate to ensure the reliability of the suspension portion 312 under maximum vibration. In an embodiment, the yoke extension portions 313 are in one-to-one correspondence to the positioning slots 10. Symmetric arrangement of the positioning slots 10 enables the positioning bracket 1 and the yoke extension portions 313 to be welded and bonded to each other more firmly, thereby improving the reliability of the sounding device 100.

In an embodiment, the positioning bracket 1 further includes a first bracket fixing portion 12, and one side of the positioning bracket body 11 away from the diaphragm 21 is bent and extends towards the yoke 31 to form the first bracket fixing portion 12. Two first bracket fixing portions 12 are provided and spaced apart from the yoke 31. One end of the elastic support component 23 is fixed to the positioning bracket body 11 and the first bracket fixing portion 12. The structure increases an area of bonding between the elastic support component 23 and the positioning bracket 1, so that the sounding device 100 has high reliability.

In an embodiment, the positioning bracket 11 further includes a second bracket fixing portion 13, and one side of the positioning bracket body 11 away from the diaphragm 21 is bent and extends towards the yoke 31. Two second bracket fixing portions 13 are provided and respectively located on the two opposite sides of the major axis of the positioning bracket 1, and are spaced apart from the yoke 31. One end of the yoke extension portion 313 away from the yoke sidewall 312 is fixed to the positioning bracket body 11 and the second bracket fixing portion 13. The structure increases an area of bonding between the yoke 31 and the positioning bracket 1, so that the sounding device 100 has high reliability.

Compared with the related art, in the sounding device according to the disclosure, one side of the positioning bracket body of the positioning bracket close to the yoke is recessed towards the diaphragm to form the positioning slot, a bending and extending yoke extension portion is arranged on the yoke sidewall of the yoke, the yoke extension portion is received in the positioning slot, and one side of the yoke extension portion close to the diaphragm abuts against a bottom surface of the positioning slot. The structure uses a position of the yoke extension portion as a height positioning surface of the yoke, which enables the magnetic circuit system and the positioning bracket to be positioned accurately and reserves a sufficient vibration space for the vibration system. In the structure, one end of the yoke extension portion away from the yoke sidewall is fixed to the positioning bracket, so that the structure is simple, the positioning bracket is fixed to increase hardness of the structure, and the positioning bracket and the yoke are not prone to move relative to each other, which effectively ensures fixation stability of the positioning bracket to the yoke, thereby improving reliability of the sounding device.

The above only illustrates some embodiments of the disclosure. It should be noted that those of ordinary skill in the art may also make improvements without departing from the principle of the disclosure, all of which fall within the protection scope of the disclosure.

What is claimed is:

1. A sounding device, comprising:

a positioning bracket;

a vibration system fixed to the positioning bracket, wherein the vibration system comprises a diaphragm fixed to the positioning bracket and a voice coil configured to drive the diaphragm to vibrate; and a magnetic circuit system configured to drive the vibration system to vibrate to produce sound, wherein the magnetic circuit system comprises a yoke fixed to the positioning bracket and a magnet received in the yoke, wherein the yoke comprises a yoke body and a yoke sidewall bending and extending from a periphery of the yoke body towards the diaphragm, the magnet is fixed to the yoke body and spaced apart from the yoke sidewall to form a magnetic gap, and the voice coil is inserted in the magnetic gap; and wherein the positioning bracket comprises a positioning bracket body and at least one positioning slot, wherein one side of the positioning bracket body close to the yoke extends towards the diaphragm to form the at least one positioning slot; the yoke further comprises at least one yoke extension portion bending and extending from the yoke sidewall towards the positioning bracket and received in one of the at least one positioning slot; and one side of one of the at least one yoke extension portion close to the diaphragm abuts against a bottom surface of one of the at least one positioning slot, and one end of one of the at least one yoke extension portion away from the yoke sidewall is fixed to the positioning bracket.

2. The sounding device as described in claim 1, wherein the positioning bracket is made of a metal material, and one side of one of the at least one yoke extension portion away from the yoke sidewall has a part in contact with the positioning bracket, wherein the part is welded to the positioning bracket by laser.

3. The sounding device as described in claim 1, wherein the vibration system further comprises a framework fixed to one side of the diaphragm close to the magnetic circuit system and an elastic support component elastically supporting the framework, wherein the elastic support component has one end fixed to the positioning bracket body and another end fixed to the framework; and the voice coil is connected to the diaphragm through the framework.

4. The sounding device as described in claim 3, wherein the framework comprises a framework body in a ring shape and fixed to the diaphragm, a first framework fixing portion extending from an outer periphery of the framework body towards the magnetic gap, and at least one second framework fixing portion extending from an inner periphery of the framework body toward the voice coil, wherein the elastic support component is connected to one end of the first framework fixing portion away from the framework body, and the voice coil is connected to the at least one second framework fixing portion.

5. The sounding device as described in claim 4, wherein the at least one second framework fixing portion comprises a plurality of second framework fixing portions that is spaced apart from each another.

6. The sounding device as described in claim 3, wherein the positioning bracket further comprises two first bracket fixing portions each bending and extending from one side of the positioning bracket body away from the diaphragm towards the yoke, the two first bracket fixing portions each are spaced apart from the yoke, and one end of the elastic support component is fixed to the positioning bracket body and the two first bracket fixing portions.

7. The sounding device as described in claim 1, wherein the positioning bracket further comprises two second bracket fixing portions each bending and extending from one side of the positioning bracket body away from the diaphragm towards the yoke, the two second bracket fixing portions are respectively located at two opposite sides of a major axis of the positioning bracket and are spaced apart from the yoke, and one end of one of the at least one yoke extension portion away from the yoke sidewall is fixed to the positioning bracket body and one of the two second bracket fixing portions.

8. The sounding device as described in claim 1, wherein the at least one positioning slot comprises two positioning slots respectively located at two opposite sides of a major axis of the positioning bracket, the yoke is of a rectangular structure, the at least one yoke extension portion comprises two yoke extension portions respectively located at two opposite sides of a major axis of the yoke, and the two yoke extension portions are in one-to-one correspondence to the two positioning slots.

9. The sounding device as described in claim 8, wherein the diaphragm comprises a vibration portion, a suspension portion bending and extending from an outer periphery of the vibration portion, and a connection portion bending and extending from the suspension portion towards the positioning bracket, wherein the voice coil is fixed to the vibration portion, the connection portion is fixed to the positioning bracket body, the suspension portion is recessed towards the yoke to form an arc-shaped structure directly opposite to one of the at least one positioning slot, and a distance between the suspension portion and the positioning slot is greater than a maximum vibration amplitude of the suspension portion.

10. The sounding device as described in claim 9, wherein the diaphragm further comprises a reinforcement portion bending and extending from an outer periphery of the connection portion along an extension direction of the positioning bracket body, wherein the reinforcement portion has a ring shape and is fixed to the positioning bracket body.

* * * * *